US005141272A

United States Patent [19]

Veillette

[11] Patent Number: 5,141,272

[45] Date of Patent: Aug. 25, 1992

[54] DOOR AND WINDOW LATCH

[76] Inventor: Pierre Veillette, 6 - 41 Georges Bilodeau, Hull, Quebec, Canada, J8Z 1T1

[21] Appl. No.: 830,384

[22] Filed: Feb. 3, 1992

[51] Int. Cl.[5] ..... E05C 17/24

[52] U.S. Cl. ..... 292/338; 292/277; 292/DIG. 46

[58] Field of Search ..... 292/277, 278, 338, 150, 292/175, 269, 305, DIG. 46, DIG. 47

[56] References Cited

U.S. PATENT DOCUMENTS

| | | | |
|---|---|---|---|
| 1,056,003 | 3/1913 | Burlew | 292/277 |
| 1,508,029 | 9/1924 | Segal | 292/150 X |
| 1,621,934 | 3/1927 | Kintner | 292/150 |
| 1,965,723 | 7/1934 | Rupp | 292/277 X |
| 4,227,725 | 10/1980 | Lindquist et al. | 292/305 X |
| 4,263,795 | 4/1981 | Van Gompel | 292/DIG. 46 X |
| 4,570,985 | 2/1986 | Waldo et al. | 292/DIG. 46 X |

*Primary Examiner*—Richard E. Moore
*Attorney, Agent, or Firm*—George A. Seaby

[57] ABSTRACT

In general, latch devices for sliding patio doors are complicated and/or intended to lock a door fully closed. A simple device for latching a sliding door or window partly or fully open or fully closed includes a track for mounting on a frame opposite the side edge of a movable door or window panel; a slide for slidable mounting on the track; a bracket for mounting on the edge of the panel at the bottom thereof; a rod pivotally connected to the slide and to the bracket; a bolt slidable in a recess in the slide body which contains a spring for biasing the bolt outwardly against teeth on the track, the teeth normally permitting movement of the slide in one direction on the track so that the door can be closed but not opened; and a pin for insertion through the slide into the bolt to hold the bolt retracted in the slide, so that the door can move freely between the open and closed positions.

8 Claims, 3 Drawing Sheets

DOOR AND WINDOW LATCH

BACKGROUND OF THE INVENTION

1. Field of the Invention

This invention relates to a latch device, and in particular to a sliding door latch.

While the device of the present invention was originally designed as a latch for a patio or other sliding door of the type including a fixed panel and a slidable panel, it will be appreciated that the device can also be used with other sliding doors and windows.

Often (for example during summer nights), it is desirable to leave a patio door partly open for ventilation purposes. However, even if an outer screen door is locked, such a practice can be quite dangerous.

2. Discussion of the Prior Art

Sliding door latches already exist. Examples of such devices are described in U.S. Pat. Nos. 3,471,189; issued to J. M. Ness on Oct. 7, 1969; 3,583,743, issued to S. Newell on Jun. 8, 1971; 3,630,560, issued to N. C. Atkins et al on Dec. 28, 1971; 4,295,676, issued to J. A. Smith on Oct. 20, 1981; 4,318,559, issued to C. Burton on Mar. 9, 1982; 4,438,640, issued to R. E. Willis on Mar. 27, 1984 and 4,826,225, issued to W. G. Styles on May 2, 1989.

In general, existing devices of the type described in the above listed patents are intended to permit either opening or locking of a door in the fully closed position. Alternatively, existing latches or locks are unduly complicated in terms of structure or operation. If production of a device is labour intensive or relies on complicated elements, the device becomes so expensive that it is never mass produced or does not gain public acceptance.

Accordingly, a need still exists for a device which can be used for latching a sliding door partly open or closed.

GENERAL DESCRIPTION OF THE INVENTION

An object of the present invention is to meet this need by providing a latch device for use with a sliding door or window which is relatively simple in terms of both structure and operation.

Accordingly, the present invention relates to a latch device for use on a sliding door or window of the type including a frame and a panel slidable in the frame between open and closed positions, comprising track means for mounting on one side the frame opposite the free side of the slidable panel in the closed position; slide means slidable on said track means; arm means pivotally connecting said slide means to said one side of the slidable panel; bolt means slidable in said slide means; stop means on said track means for engagement by said bolt means in a plurality of positions, said stop means normally permitting movement of said slide means towards the panel closing position only; and release means for manually disengaging said bolt means from said stop means to permit partial or full opening of the door or window.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

Figure 1:
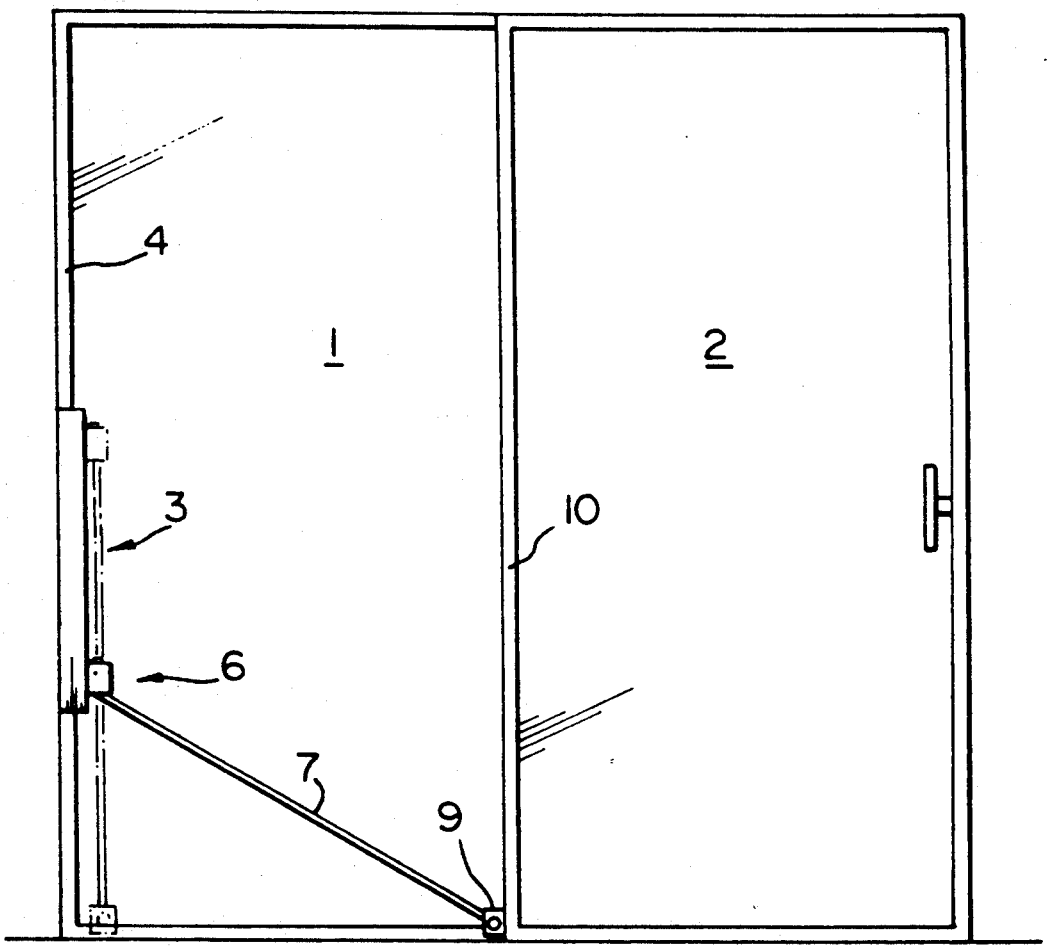
FIG. 1 is a schematic front view of a patio door incorporating a latch device in accordance with the present invention.

Referring to FIG. 1, the latch device of the present invention is intended for use, inter alia, on a sliding patio door of the type including a fixed panel 1 and a slidable panel 2. The principal elements of the device include a track generally indicated at 3 for mounting a door frame (not shown) in front of one side 4 of the fixed door panel 1, a slide 6 mounted on the track 3, and an arm or bar 7 pivotally connected to the slide 6 and to a bracket 9 mounted on the bottom of the free side 10 of the sliding panel 2 in the closed position.

Figure 2:
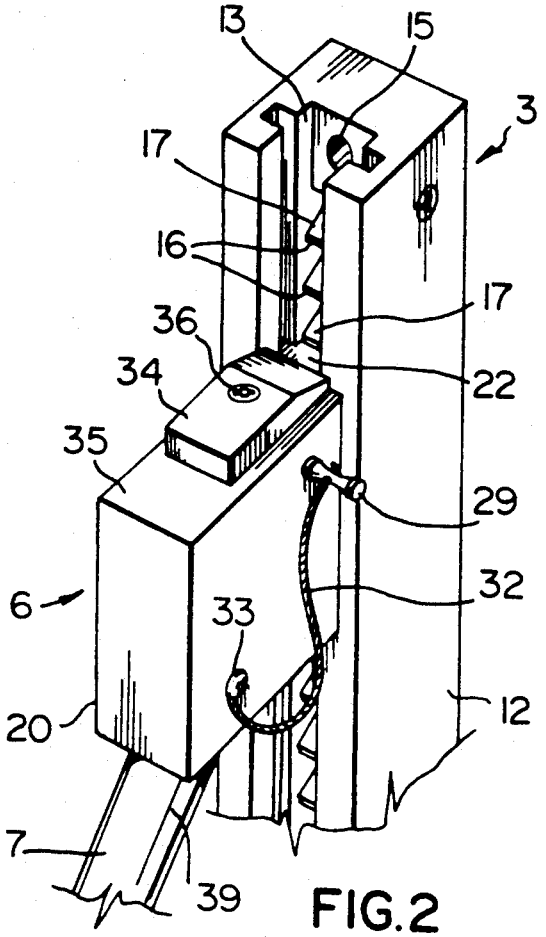
FIG. 2 is a perspective view from above of one end of the latch device of FIG. 1.
Figure 4:
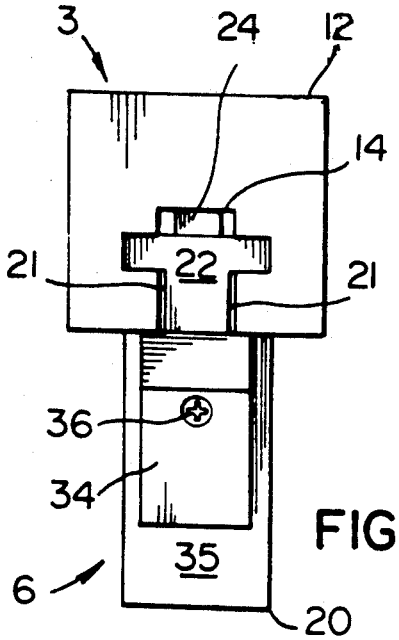
FIG. 4 is a plan view of the device of FIGS. 1 and 2.
Figure 3:
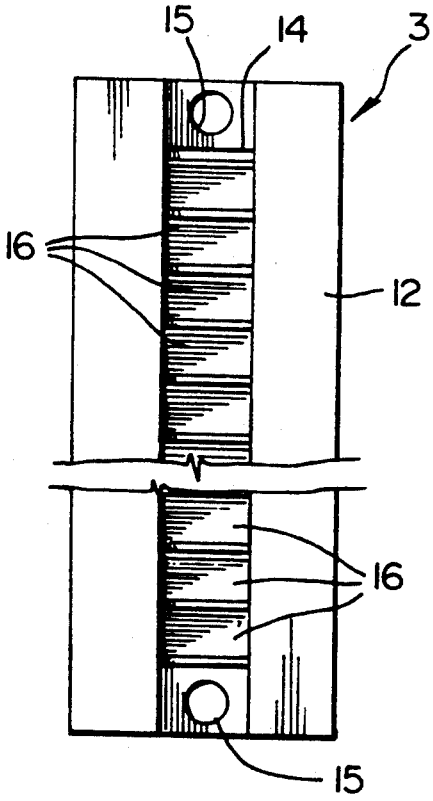
FIG. 3 is a front view of a track used in the device of FIGS. 1 and 2.
Figure 6:
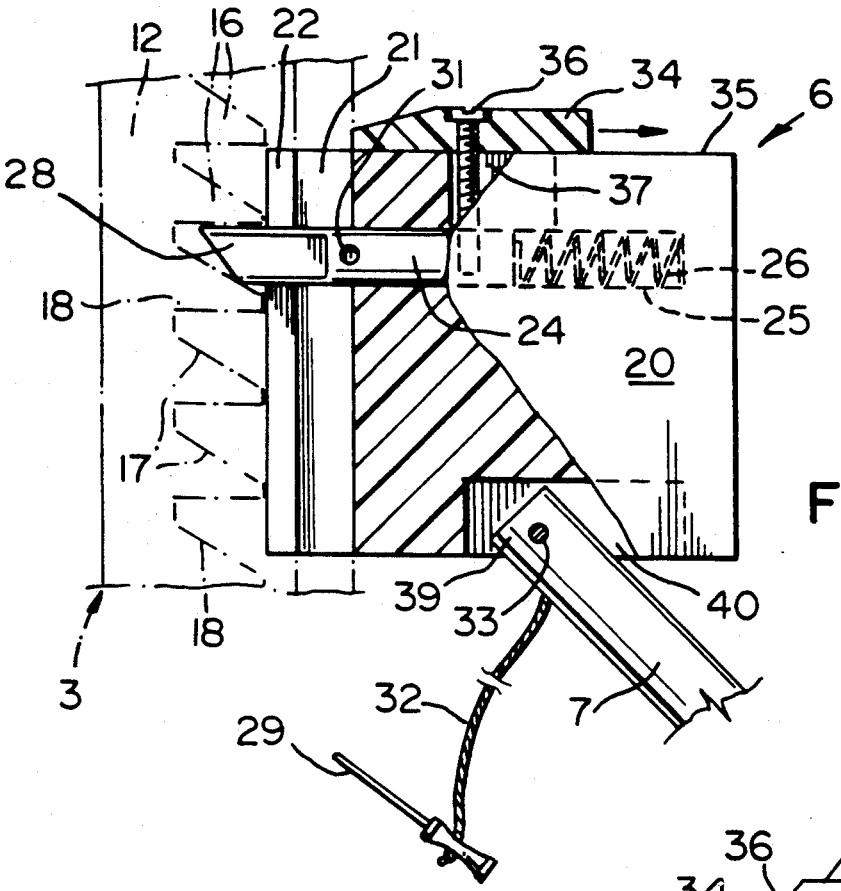
FIG. 6 is a partly sectioned front view of the device of FIGS. 1 to 4.

As best shown in FIGS. 2 to 4, the track 3 is an elongated, rectangular, plastic bar 12, with a generally cruciform cross section slot 13 extending the entire length thereof for slidably receiving the slide 6. The inner arm 14 (FIG. 4) of the slot 13 includes holes 15 at the top and bottom ends for receiving screws (not shown) for mounting the track 3 on the door frame. A plurality of teeth 16 defining a continuous rack are provided between the holes 14. As best shown in FIG. 6, the teeth 16 define a plurality of contiguous top inclined ramps 17 and bottom horizontal shoulders 18.

Figure 5:
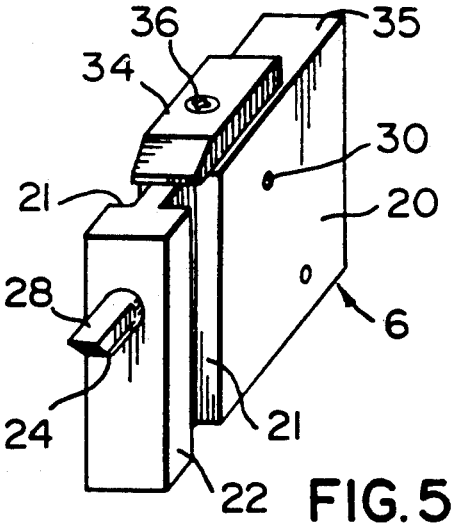
FIG. 5 is a perspective view from one end of a slide used in the device of FIGS. 1 to 3.

As mentioned above, the slide 6 is slidably mounted in the track 3. The slide 6 includes a rectangular plastic body 20 with opposed grooves 21 near one end thereof defining a T-shaped projection 22 for sliding in the track slot 13. A bolt 24 is slidably mounted in a bore or cylindrical recess 25 in such one end of the body 20. A helical spring 26 (FIG. 6) in the recess 25 biases the bolt 24 outwardly so that the pointed outer end 28 thereof engages the teeth 16. The top of the outer end 28 (FIGS. 5 and 6) of the bolt 24 is flat for engaging the horizontal teeth shoulders 18. The bolt 24 can be retracted into the recess 25 and retained therein by a pin 29, which is inserted through aligned holes 30 and 31 (FIGS. 5 and 6) in the body 20 and the bolt 24, respectively. The pin 29 is carried by a string 32 connected to the bottom of the body 20 by a screw 33. A button 34 is slidably mounted on the body 20 for moving the bolt 24 inwardly against the bias of the spring 26. A screw 36 extends through the button 34 and a slot 37 in the body 20 into the bolt 24. Thus, by sliding the button 34 away from the projection 22 and the track 3, the bolt 24 is moved out of engagement with the teeth 16, permitting free sliding of the slide 6 in the track 3.

Figure 7:
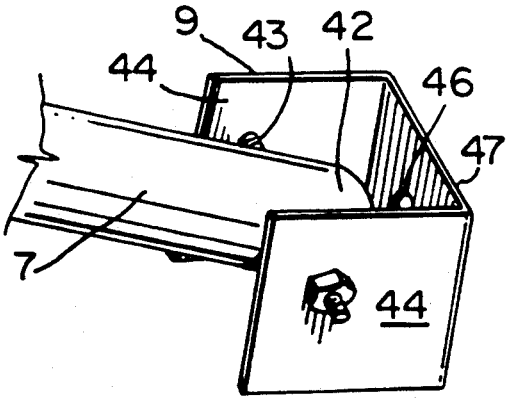
FIG. 7 is a perspective view from above of the other end of the device of FIG. 1.

One end 39 of the arm 7 is pivotally mounted in rectangular recess 40 (FIG. 6) in the bottom of the slide body 20. For such purpose, the screw 33 extends through the body 20 and the top end 39 of the arm 7. As best shown in FIG. 7, the other end 42 of the arm 7 is pivotally mounted on a bolt 43 extending between the sides 44 of the generally U-shaped bracket 9. A hole 46 for receiving a mounting screw (not shown) is provided in the bight or web 47 of the bracket 9.

It will be appreciated that the above described latch device can be used on virtually any door or window of the sash-type. By mounting an adapter (not shown) on one end of a Pierson window for carrying the bracket 9, the device can also be used on such windows.

In operation, with the sliding panel 2 of the door closed and the bolt 24 engaging one of the teeth 16, the door cannot be opened, since any lateral pressure on the panel 2 towards the track 3 would merely press the top of the outer end 28 of the bolt 24 more firmly against a horizontal shoulder 18 of the tooth 16. By grasping the slide 6, using the thumb, the slide 34 can be caused to move away from the track 3. Thus, the bolt 24 is moved out of engagement with the teeth 16, so that the slide can move freely along the track 3 in either direction to open the door. When free movement of the door between the open and closed position is desired, the bolt 24 is retracted, and the pin 29 is inserted through the aligned openings 30 and 31.

When the door is to be latched partly open, e.g. for ventilation, the bolt 24 is retracted and the panel 2 is slid to the desired location. When the slide 34 is released, the spring 26 pushes the bolt 24 into engagement with one of the teeth 16. Thus, the door panel 2 can be moved in one direction only, namely towards the closed position. Any attempt to open the door will merely result in more secure latching, i.e. pressing of the bolt 24 against one of the shoulders 18. Because the block 6 and the slide 34 are on the frame side remote from the handle side of the sliding panel 2, the slide 34 cannot be reached from the outside to release the latch.

It will be appreciated that the track 3 and slide 6 (and, for that matter, the arm 7) can be formed of plastic. For strength, the arm 7 is preferably formed from a length of metal tubing. The simplicity of the structure defined herein lends itself to relatively inexpensive mass production. Moreover, the device can easily be operated using one hand. Finally, it will be appreciated that the track 3 can be mounted on the free edge of the sliding panel, with the bracket 9 on the door frame.

I claim:

1. A latch device for use on a sliding door or window of the type including a frame and a panel slidable in the frame between open and closed positions, comprising track means for mounting on one side the frame opposite the free side of the slidable panel in the closed position; slide means slidable on said track means; arm means pivotally connecting said slide means to said one side of the slidable panel; bolt means slidable in said slide means; stop means on said track means for engagement by said bolt means in a plurality of positions, said stop means normally permitting movement of said slide means towards the panel closing position only; and release means for manually disengaging said bolt means from said stop means to permit partial or full opening of the door or window.

2. A latch device according to claim 1, wherein said stop means includes a plurality of contiguous teeth means on said track means for releasable engagement by said bolt means.

3. A latch device according to claim 2, including slot means in said track means for slidably retaining said slide means, said slot means containing said tooth means.

4. A latch device according to claim 3, wherein said slide means includes body means; and spring means in said body means for biasing said bolt means into engagement with said tooth means.

5. A latch device according to claim 4, wherein said release means includes handle means connected to said bolt means, permitting manual movement of said bolt means out of engagement with said tooth means against the bias of said spring means.

6. A latch device according to claim 5, including pin means insertable into said body means and said bolt means for releasably retaining the bolt means out of engagement with said tooth means, whereby the slide means can move freely in either direction, permitting unimpeded opening and closing of the door or window.

7. A latch device according to claim 4, wherein said slot means in said track means is cruciform in cross section, and one end of said body means is T-shaped in cross section for limiting movement of the slide means to vertical sliding when the device is in use.

8. A latch device for use on a sliding door or window of the type including a frame and a panel slidable in the frame between open and closed positions comprising track means for mounting on one side of the frame opposite the free side of the slidable panel in the closed position; slide means slidable in said track means; bracket means for mounting on said free side of the slidable panel proximate the bottom thereof; rod means for pivotal connection to said slide means and to said bracket means; bolt means slidable in said slide means; a plurality of tooth means in said track means permitting movement of the slide means in one direction; spring means in said slide means for biasing said bolt means against said tooth means, whereby the panel can be slid to a closed position only when said bolt means engages one said tooth means; handle means on said slide means for retracting said bolt means into the slide means to release the slide means for free movement along said track means, whereby the panel can be slid freely between open and closed positions; and pin means for insertion through said slide means into said bolt means to retain the latter in the retracted position.

* * * * *